US010856574B2

(12) United States Patent
Ghiotti et al.

(10) Patent No.: US 10,856,574 B2
(45) Date of Patent: Dec. 8, 2020

(54) MACHINE FOR PRODUCING SUBSTANTIALLY CYLINDRICAL ARTICLES

(71) Applicant: G.D SOCIETA' PER AZIONI, Bologna (IT)

(72) Inventors: Roberto Claudio Franco Ghiotti, Monte S. Pietro (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 114 days.

(21) Appl. No.: 15/767,678

(22) PCT Filed: Oct. 19, 2016

(86) PCT No.: PCT/IB2016/056276
§ 371 (c)(1),
(2) Date: Apr. 12, 2018

(87) PCT Pub. No.: WO2017/068506
PCT Pub. Date: Apr. 27, 2017

(65) Prior Publication Data

US 2018/0303159 A1 Oct. 25, 2018

(30) Foreign Application Priority Data

Oct. 19, 2015 (IT) ..... 102015000062991

(51) Int. Cl.
*A24C 5/06* (2006.01)
*A24F 47/00* (2020.01)
(Continued)

(52) U.S. Cl.
CPC ..... *A24F 47/006* (2013.01); *A24C 5/06* (2013.01); *B65B 1/10* (2013.01); *B65B 1/24* (2013.01);
(Continued)

(58) Field of Classification Search
CPC .. A24C 5/06; A24C 5/47; A24C 5/474; A24C 5/01; B65B 43/42; B65B 43/44;
(Continued)

(56) References Cited

U.S. PATENT DOCUMENTS 4,782,644 A 11/1988 Haarer et al.
6,336,896 B1 1/2002 Hsu et al.
(Continued)

FOREIGN PATENT DOCUMENTS

EP 0257230 A2 3/1988
EP 1228709 A1 8/2002
(Continued)

OTHER PUBLICATIONS

International Application No. PCT/IB2016/056276, International Search Report and Written Opinion, dated Mar. 9, 2017.

*Primary Examiner* — Michael H. Wilson
*Assistant Examiner* — Yana B Krinker
(74) *Attorney, Agent, or Firm* — Marshall, Gerstein & Borun LLP

(57) ABSTRACT

Machine and method for producing a substantially cylindrical article, which comprises a tubular body, a container element, arranged in the area of one end of the tubular element, a heat generating element, partially housed inside the container element, and loose material for generating flavour; in use, the loose material is inserted into the container element, vertically oriented, and the heat generating element is partially inserted into the container element by being moved downwards, so as to obtain a combined element; subsequently, the combined element is at least partially inserted into the tubular body.

13 Claims, 15 Drawing Sheets

(51) Int. Cl.

| | |
|---|---|
| ***B65B 43/44*** | (2006.01) |
| ***B65B 43/46*** | (2006.01) |
| ***B65B 43/50*** | (2006.01) |
| ***B65B 43/52*** | (2006.01) |
| ***B65B 43/56*** | (2006.01) |
| ***B65B 57/16*** | (2006.01) |
| ***B65B 1/10*** | (2006.01) |
| ***B65B 1/24*** | (2006.01) |
| ***B65B 1/38*** | (2006.01) |
| ***B65B 7/28*** | (2006.01) |
| ***B65B 57/00*** | (2006.01) |

(52) U.S. Cl.
CPC ..... *B65B 1/385* (2013.01); *B65B 7/2807* (2013.01); *B65B 7/2821* (2013.01); *B65B 43/44* (2013.01); *B65B 43/46* (2013.01); *B65B 43/50* (2013.01); *B65B 43/52* (2013.01); *B65B 43/56* (2013.01); *B65B 57/00* (2013.01); *B65B 57/16* (2013.01)

(58) Field of Classification Search
CPC ... B65B 43/46; B65B 43/48–62; B65B 57/00; B65B 57/16; B65B 7/2807; B65B 7/2821; A24F 42/80; A24F 47/00–006; A24F 15/00; A24F 15/01; A24F 15/015; A24F 42/00; A24F 42/10; A24F 42/60; A24F 42/90; A24D 3/17; A24D 1/22
USPC ..... 493/39–50; 131/70, 72
See application file for complete search history.

(56) References Cited

U.S. PATENT DOCUMENTS

| | | | |
|---|---|---|---|
| 9,861,124 | B2 | 1/2018 | Liang et al. |
| 10,524,506 | B2 | 1/2020 | Nakano et al. |
| 2008/0029115 | A1 | 2/2008 | Draghetti et al. |
| 2010/0210437 | A1 | 8/2010 | Scott et al. |
| 2015/0013703 | A1 | 1/2015 | Akiyama et al. |

FOREIGN PATENT DOCUMENTS

| | | | | |
|---|---|---|---|---|
| EP | 2911537 | A2 * | 9/2015 | ..... A24C 5/327 |
| JP | S63-044493 | A | 2/1988 | |
| JP | 2002-262850 | A | 9/2002 | |
| JP | 2007-533314 | A | 11/2007 | |
| JP | 2011-62198 | A | 3/2011 | |
| JP | 2012-502637 | A | 2/2012 | |
| WO | WO-2013/164124 | A1 | 11/2013 | |
| WO | WO-2014/136719 | A1 | 9/2014 | |
| WO | WO-2014/142079 | A1 | 9/2014 | |
| WO | WO-2014/187839 | A1 | 11/2014 | |
| WO | WO-2015/140768 | A2 | 9/2015 | |

* cited by examiner

MACHINE FOR PRODUCING SUBSTANTIALLY CYLINDRICAL ARTICLES

CROSS-REFERENCE TO RELATED APPLICATIONS

This is the U.S. national phase of International Application No. PCT/IB2016/056276, filed Oct. 19, 2016, which claims the benefit of Italian Patent Application No. 102015000062991 filed Oct. 19, 2015.

TECHNICAL FIELD

The present invention relates to a machine and to a method for producing substantially cylindrical articles of the tobacco processing industry.

BACKGROUND ART

Recently, several new smoking articles, alternative to traditional cigarettes have been proposed. Said new smoking articles are made in order to provide the smoker with an experience as similar as possible to that of a cigarette.

In particular, smoking articles comprising a heat generating element and flavour generating materials have been proposed. In use, the heat generating element heats the flavour generating material, which consequently releases flavouring substances that are inhaled by the user during inhalation.

An example of this type of smoking articles is described in patent application with publication number US2015/0013703.

Currently the production of articles of the type described above and others similar is performed mostly by hand or with rudimentary machines which require the continuous use of manpower. Consequently, the production is slow (i.e. with low productivity) and the articles obtained are of greatly variable quality (and, however, generally low quality).

The patent application with publication number EP1228709A1 describes an apparatus for the production of multi-component filters. In particular, it is described that tubular elements are fed to a working station, in which the filtering material is fed into the tubular elements. A rotating unit rotates the tubular elements.

DISCLOSURE OF INVENTION

The object of the present invention is to provide a machine and a method which permit to overcome, at least partially, the drawbacks of the prior art and are, at the same time, inexpensive and easy to implement.

According to the present invention a machine is provided, as claimed in the independent claim cited below, and, preferably, in any one of the claims depending directly or indirectly from the mentioned independent claim.

BRIEF DESCRIPTION OF THE DRAWINGS

The present invention will now be described with reference to the accompanying drawings, which illustrate examples of non-limiting embodiments, wherein.

Figure 1:
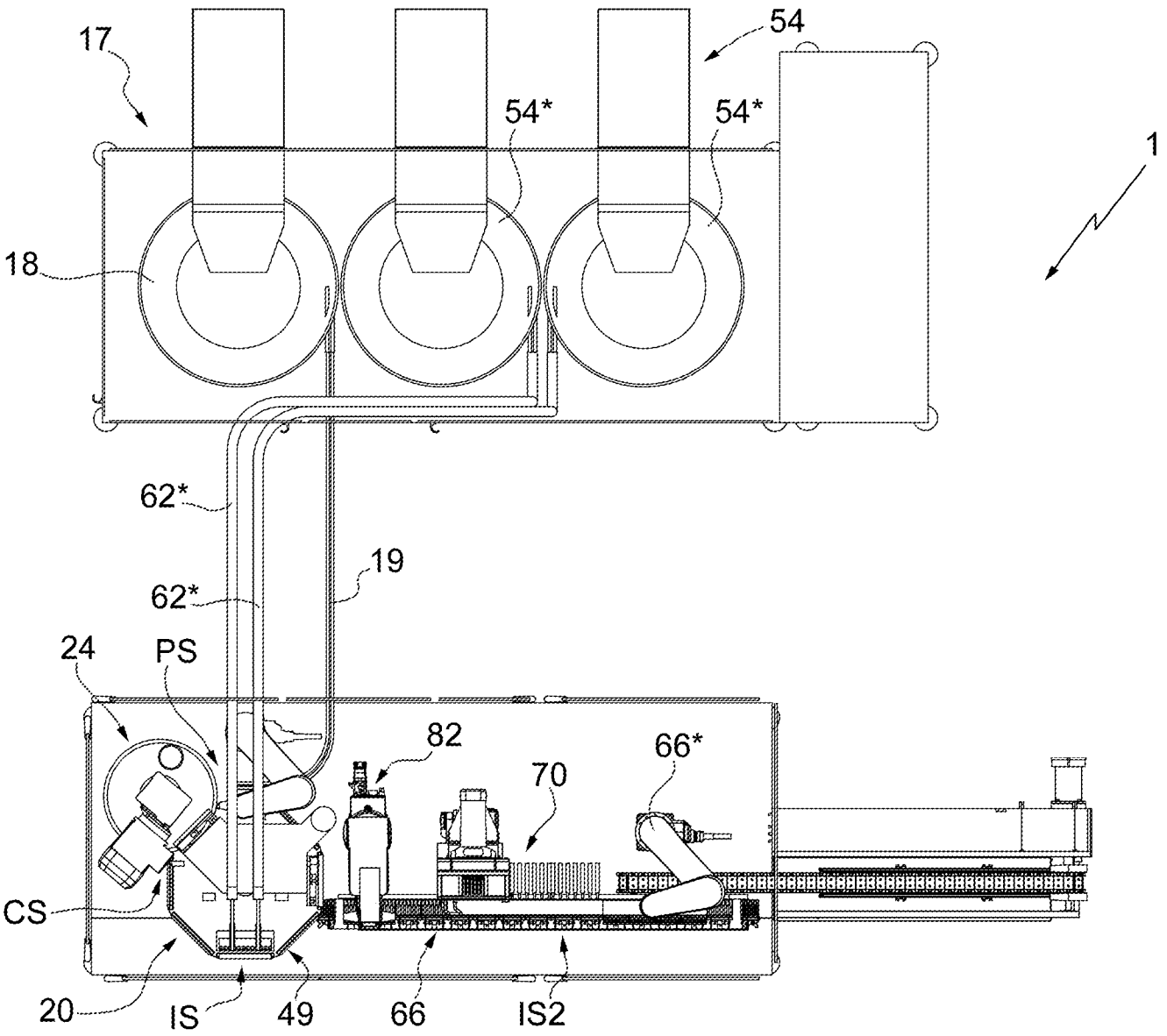
FIG. 1 is a schematic and plan view of a machine according to the present invention.
Figure 2:
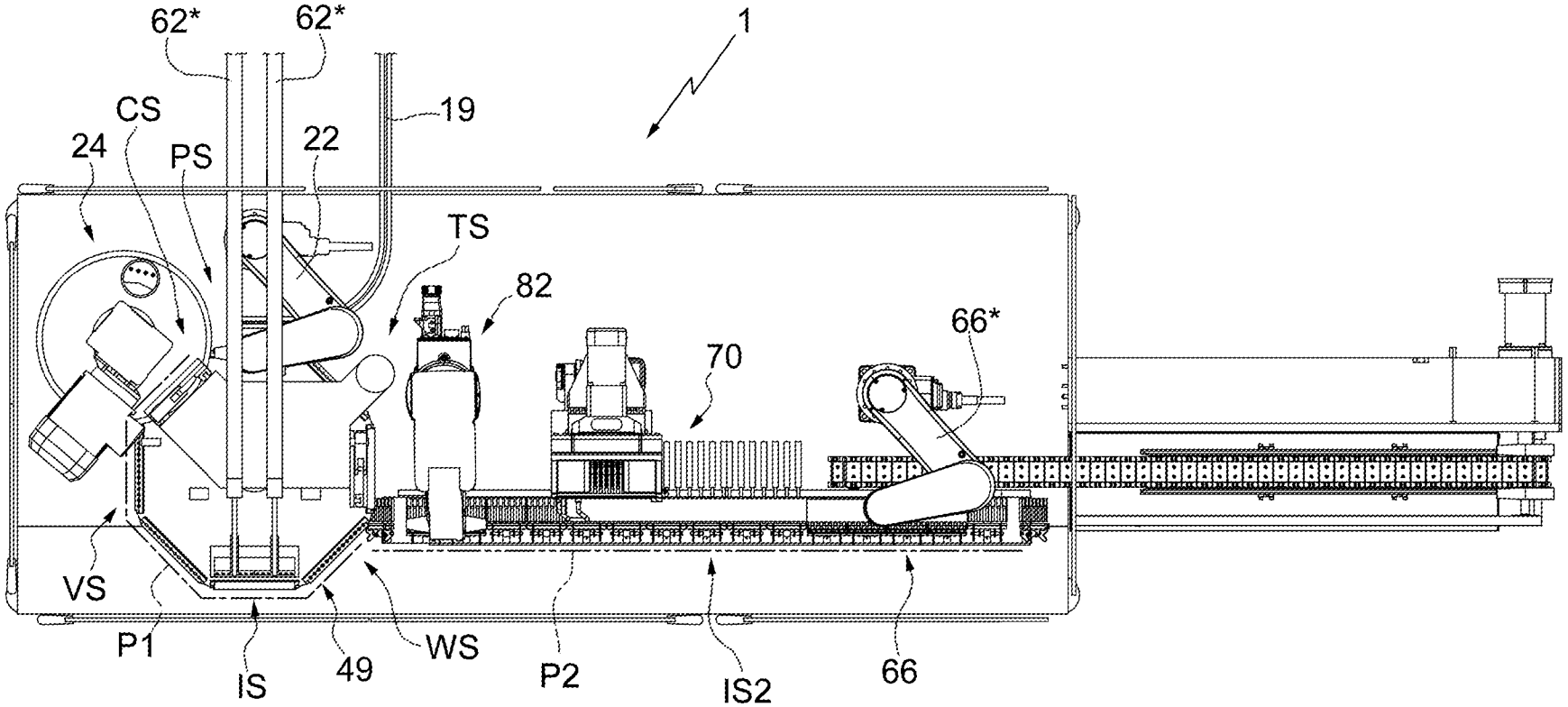
FIG. 2 illustrates in enlarged scale a part of FIG. 1.
Figure 3:
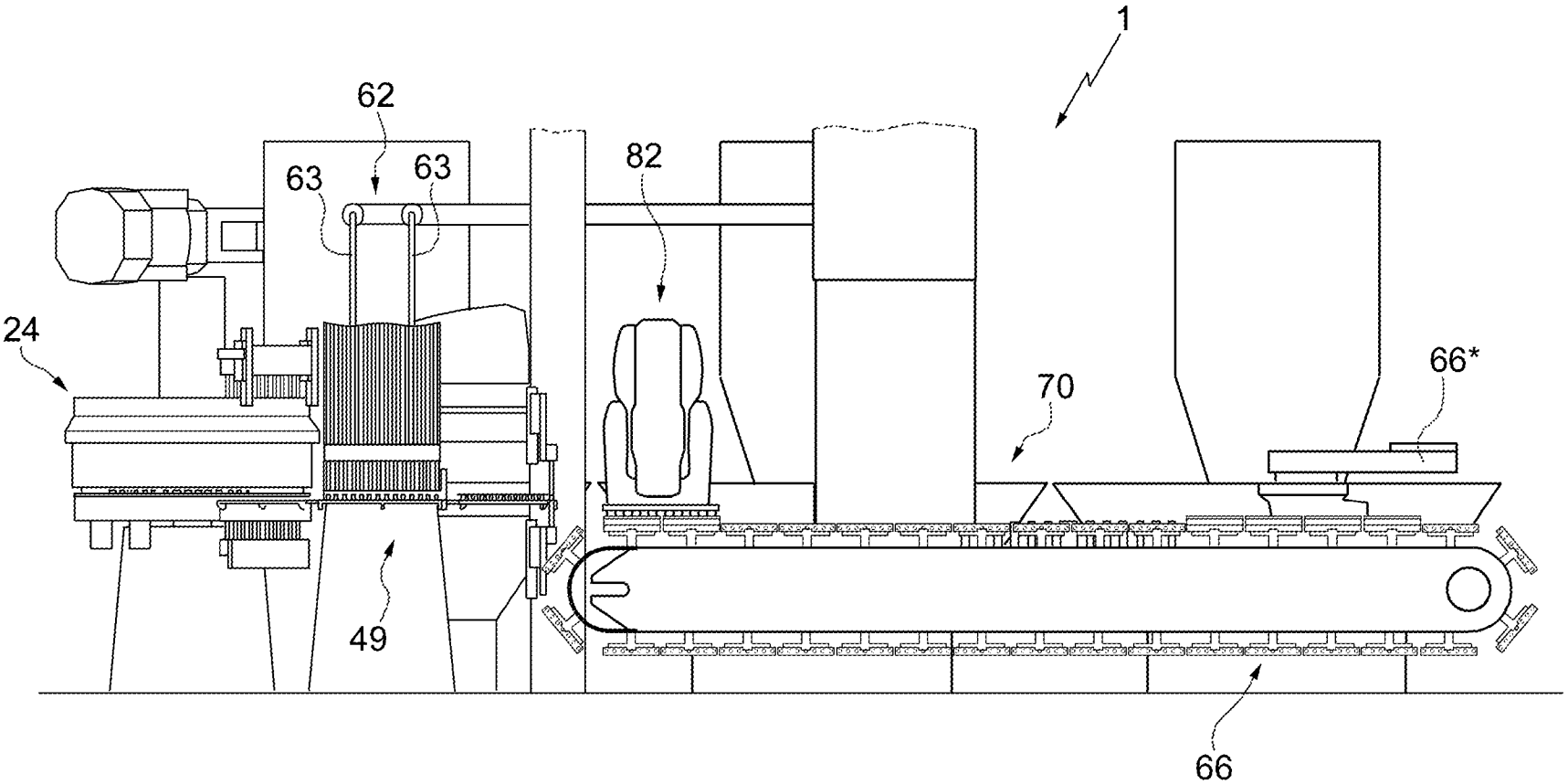
FIG. 3 is a schematic front view of the machine of FIG. 1.
Figure 12:
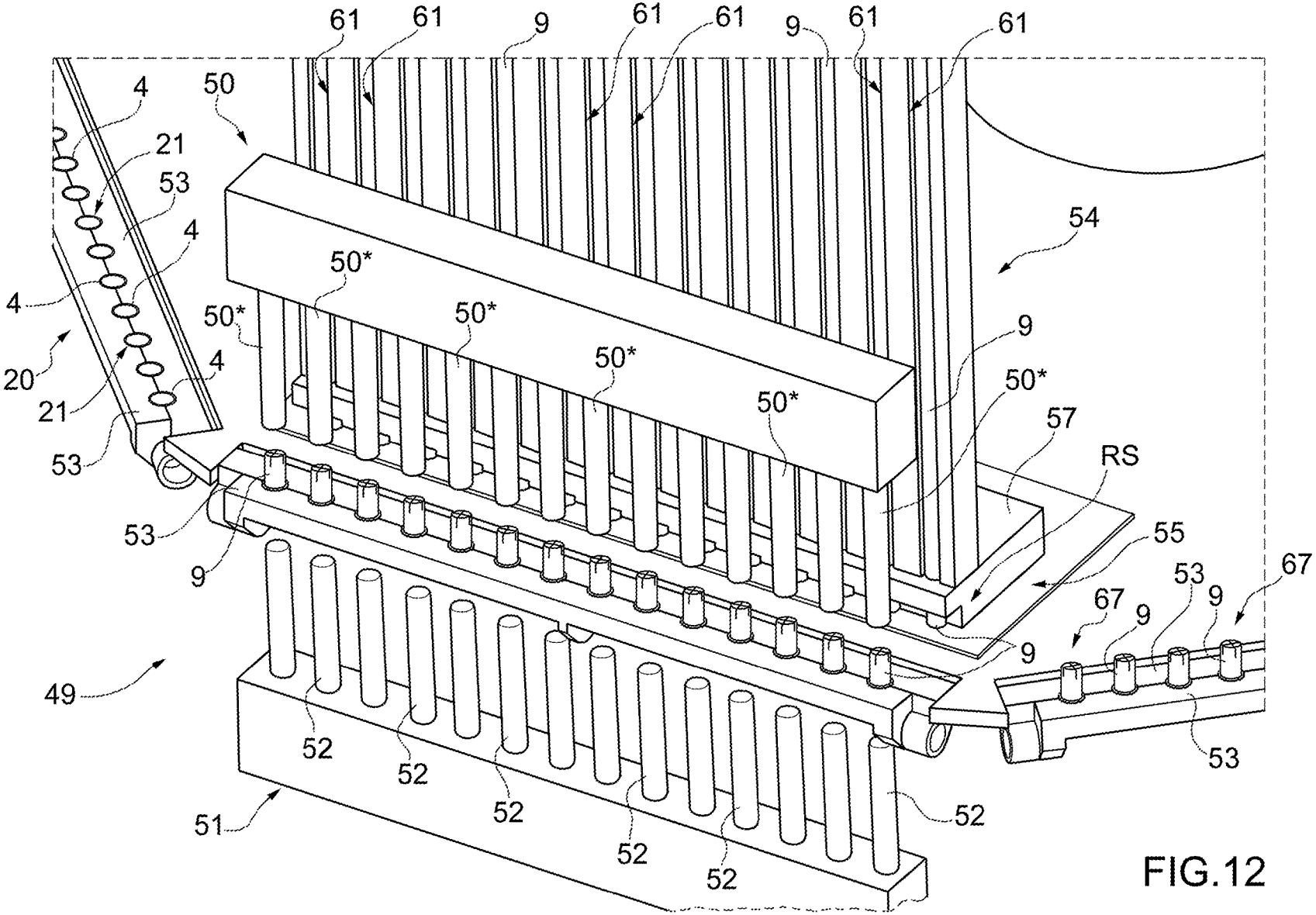
FIG. 12 is a perspective view of a portion (in particular, an insertion assembly) of the machine of FIG. 1.
Figure 16:
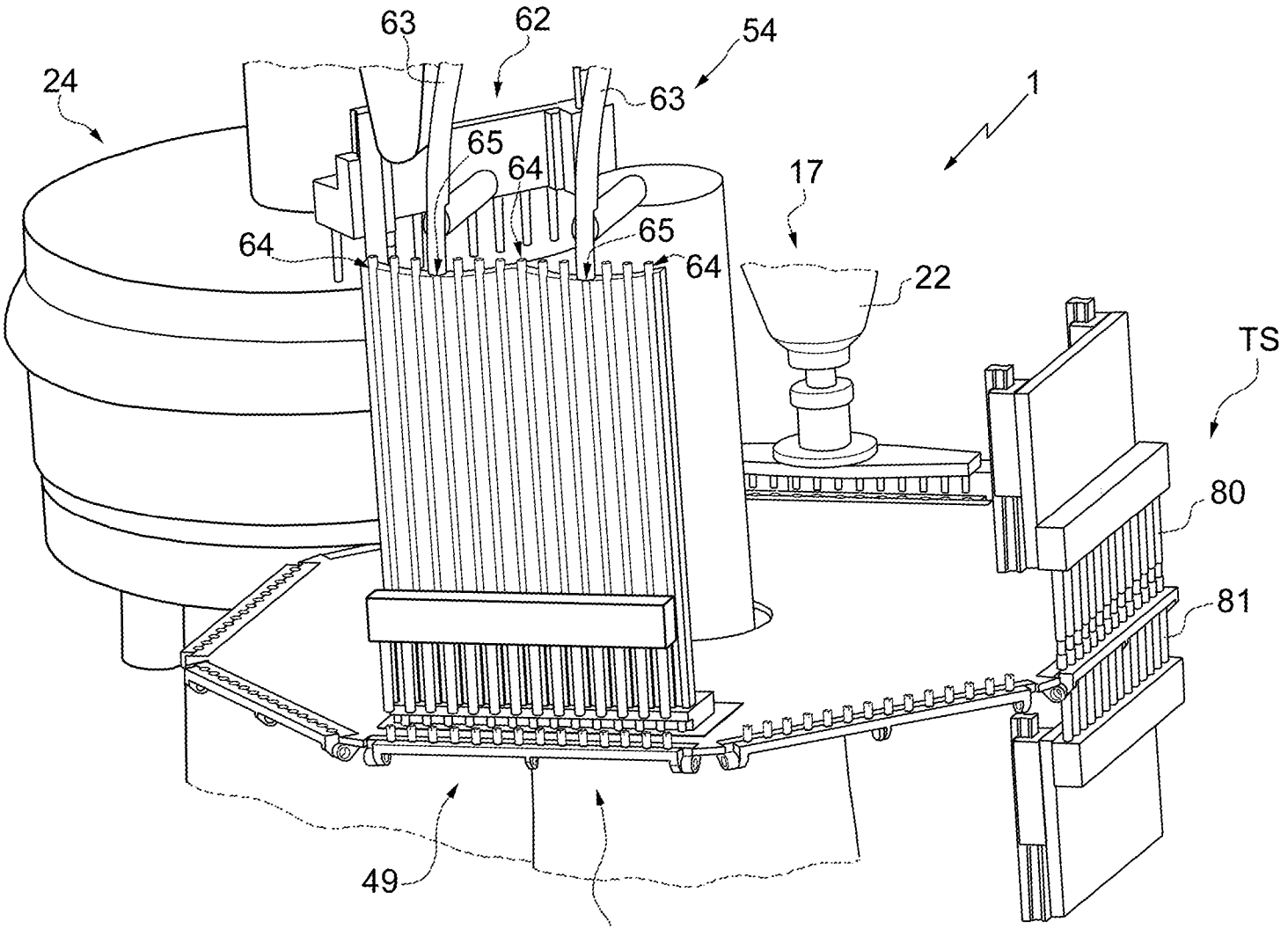
Figure 17:
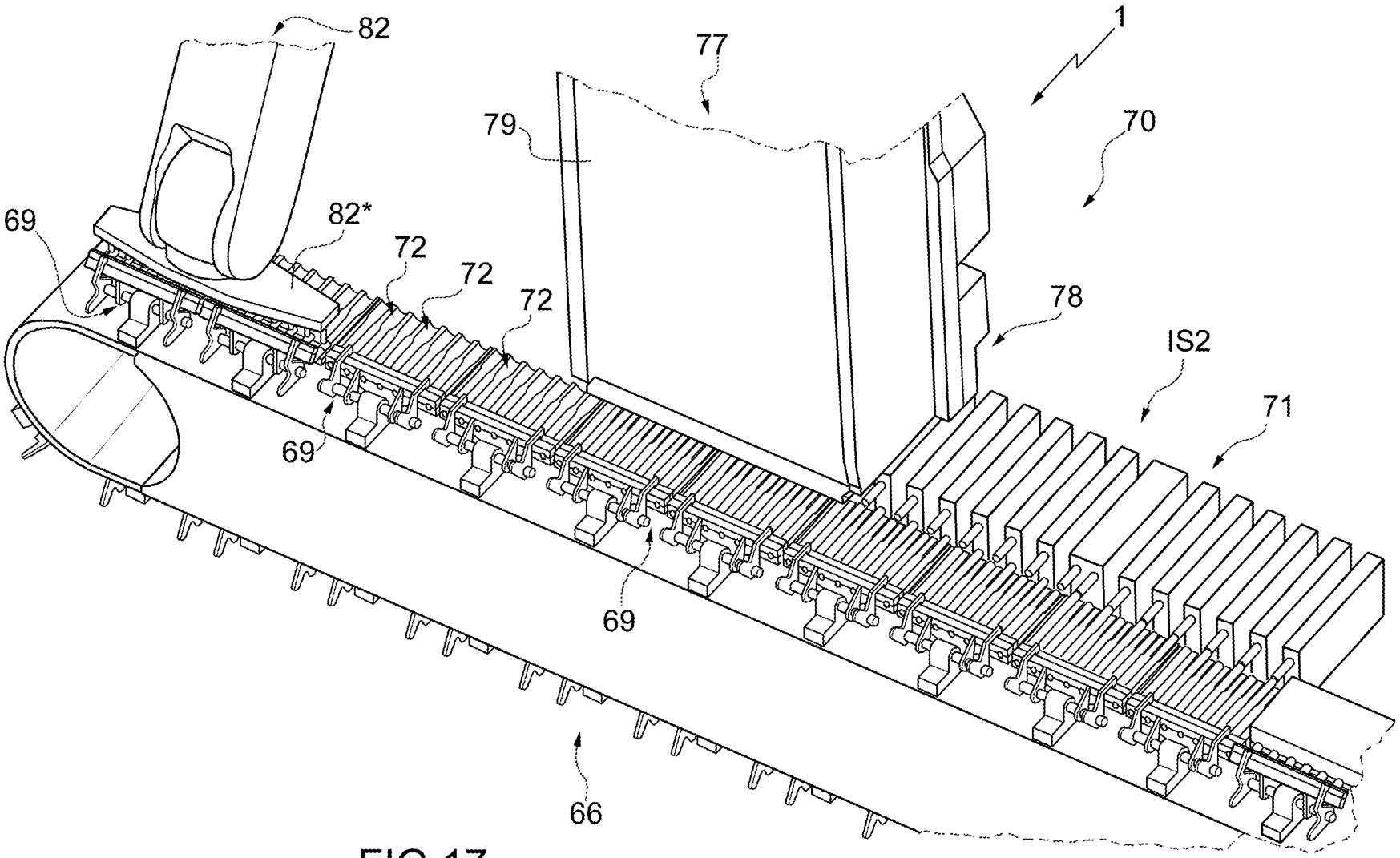
Figure 18:
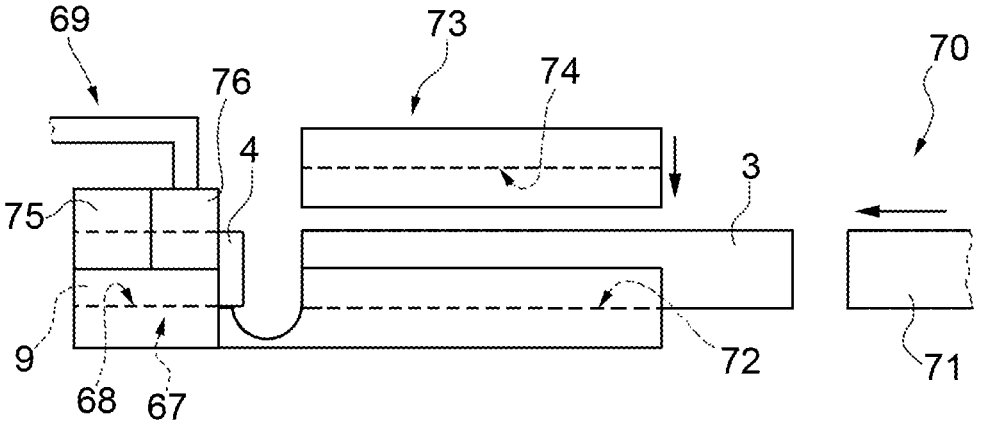
Figure 19:
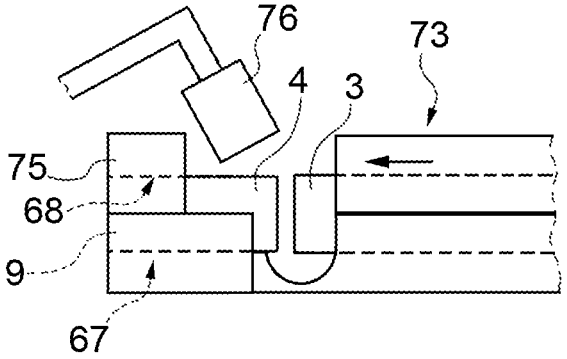
Figure 20:
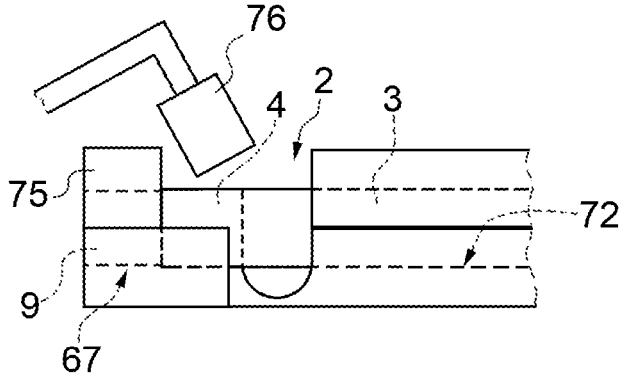

Figures from 13 to 15 are side and schematic views of the portion of FIG. 12 in successive operating configurations;

FIG. 16 is a perspective view of a part of the machine of FIG. 1 comprising the portion of FIG. 12;

FIG. 17 is a perspective view of a further portion (in particular, a further insertion assembly) of the machine of FIG. 1; and FIGS. 18-20 schematically illustrate (with side views) successive operating steps of a detail of the portion of FIG. 17.

BEST MODE FOR CARRYING OUT THE INVENTION

Figure 4:
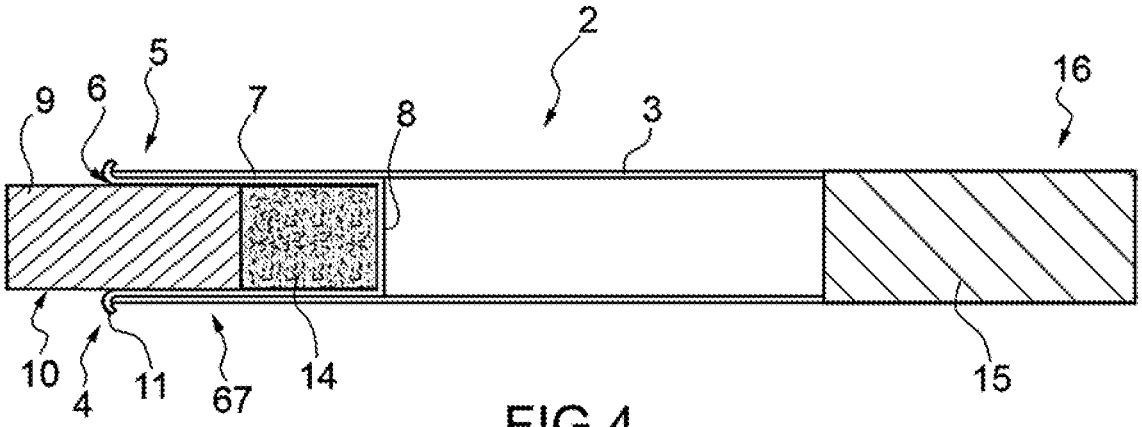
FIG. 4 is a schematic section of an article obtainable by using the machine of the figure and/or the method according to the present invention.

In FIG. 1, 1 denotes as a whole a machine for producing substantially cylindrical articles 2 (see FIGS. 4 and 5) of the tobacco processing industry. Each article 2 comprises: a tubular body 3; a container element 4, which is arranged in the area of one end 5 of the tubular body 3 and has an end opening 6 facing outwards, at least one side wall 7 and a bottom wall 8 opposite to said end opening 5; and a substantially rigid element 9, partially inside the container element 4 and having an end portion 10, which protrudes through said end opening 6 to the outside of the container element 4 (and, in particular, through the end 5 to the outside of the tubular body 3).

According to some embodiments, the container element 4 is made of paper material or the like (and is therefore easily deformable).

In particular, the bottom wall 8 is at least partially permeable to gases. According to specific embodiments, the bottom wall 8 is provided with a plurality of holes.

Advantageously, the container element (see in particular FIGS. 4 and 5) has a collar 11 that extends around the end opening 6. More precisely, the collar 11 is formed by the end edge of the side wall 7 folded on itself.

In some cases, the substantially rigid element 9 comprises (more precisely, is) a heat generating element (carbonaceous—eg. Carbon).

In particular, the substantially rigid element 9 and the container element 4 are substantially integral. The substantially rigid element 9 is shape coupled with the container element 4.

Figure 5:
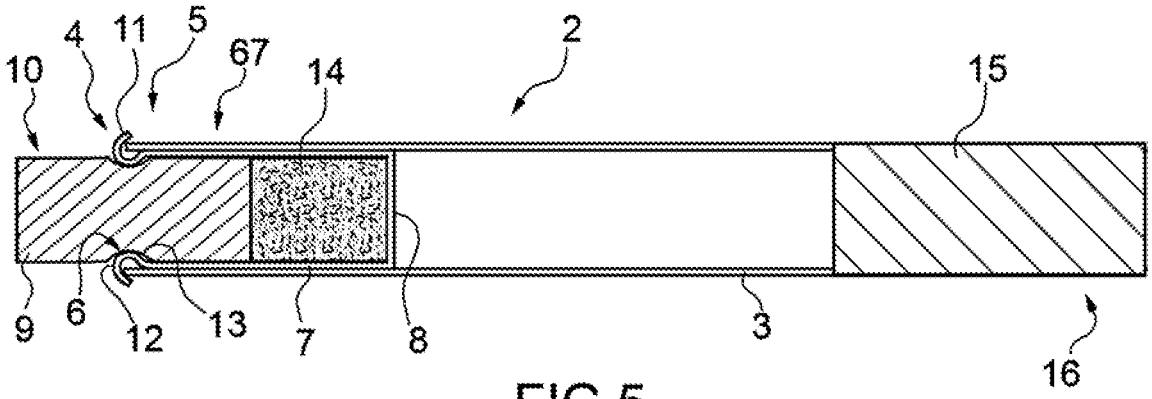
FIG. 5 is a schematic sectional view of an alternative embodiment of the article of FIG. 4.

FIG. 5 illustrates an advantageous example of embodiment, wherein the side wall 7 has a (further) deformation 12

(more precisely, a fold towards the inside of the container element 4) and the substantially rigid element 9 has respective deformation 13 (a depression) coupling with the deformation 12. The deformations 12 and 13 cooperate with each other in order to stabilize the positioning of the substantially rigid element 9 inside the container element 4.

Additionally or alternatively, glue can be provided to bind the substantially rigid element 9 to the container element 4.

Each article 2 comprises, in addition, loose material 14 (more precisely, flavour generating material), which is arranged inside the container element 4 between the substantially rigid element 9 and the bottom wall 8.

The loose material 14 is typically a powder or granular material (in particular, powder). For example, the loose material 14 comprises (more specifically, consists of) (particles of, or more precisely powder of) tobacco.

According to alternative embodiments, the article 2 comprises (instead of the loose material 14) a non-loose material (solid, in one piece).

According to specific non-limiting examples, the article 2 also comprises a filter 15 arranged in the area of one end 16 of the tubular body 3 opposite to the end 5.

According to some non-limiting embodiments (FIG. 1), the machine 1 comprises a feeding assembly 17 for the container elements 4, which feeding assembly comprises a feeding store 18, of a type known per se and schematically illustrated, adapted to provide the container elements 4 vertically oriented (with the end opening facing upwards). In particular, it comprises an inner conveyor which selects and brings up the container elements 4 with the aid of guides that interact with the collar 11. Still according to said non-limiting embodiments, the machine 1 comprises a conveyor 19 to transport the container elements from the store 18 to a working conveyor 20 (in particular a drum).

Figure 6:
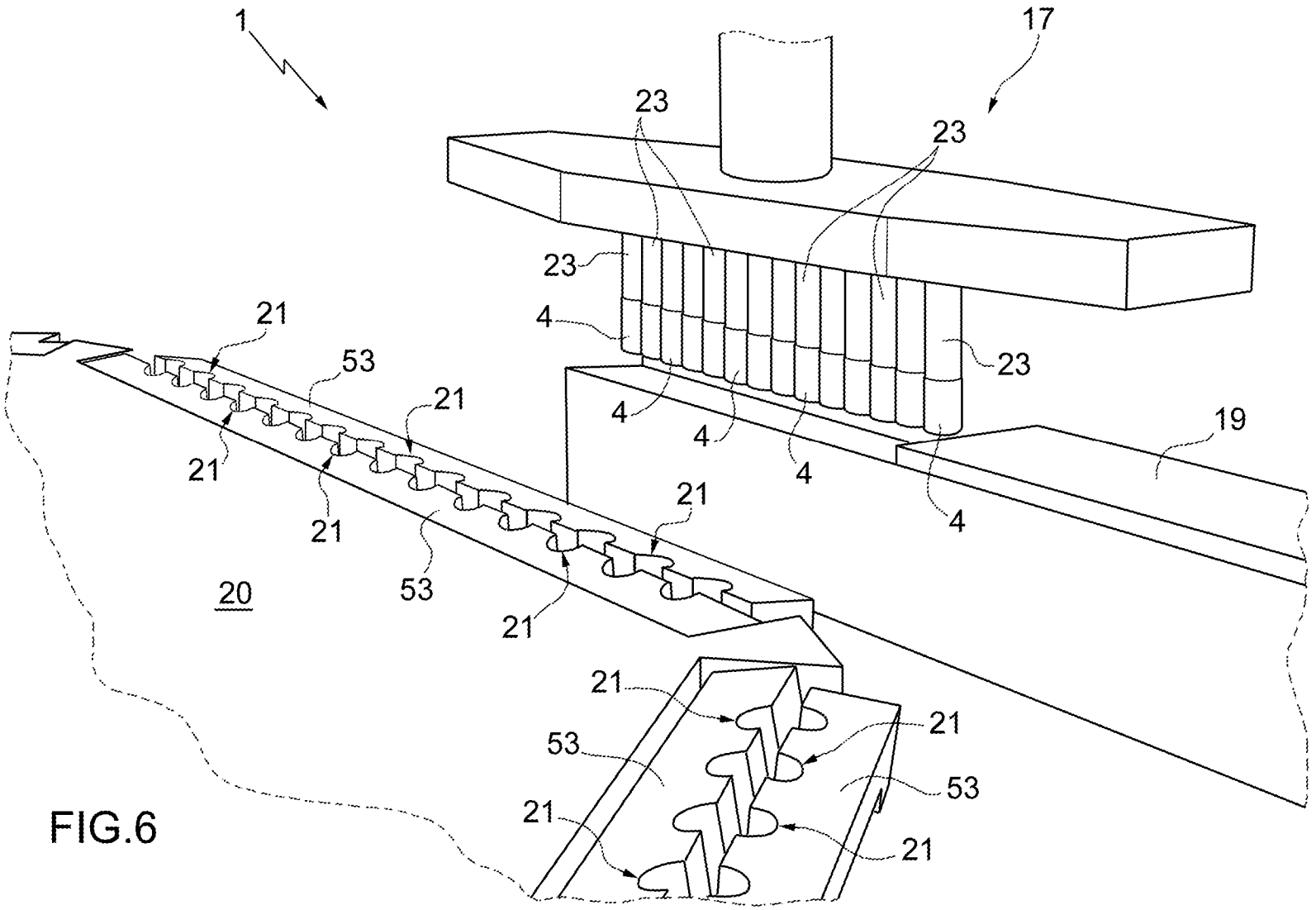
FIG. 6 is a perspective view of details of the machine of FIG. 1.

According to non-limiting embodiments the conveyor 20 is set into rotation with an intermittent motion, i.e. a non continuous motion which provides a cyclic alternation of motion steps, in which the conveyor 20 is moving, and stopping steps, wherein the conveyor 20 stops. The conveyor 20 is provided with a number of seats 21 formed on the periphery of the conveyor 20 itself and divided into groups. In particular, each group has a number of seats 21 arranged along a straight line (so as to define, in plan, a polygon on the surface of the conveyor 20). As illustrated in FIG. 6, each group has fourteen seats 21 arranged in a straight line.

The subsequent steps of the manufacturing process of the articles 2 (such as, for example, the loading of loose material 14, the insertion of the substantially rigid element 9) contained in the seats 21 of the same group are performed in parallel, i.e. taking place simultaneously for all the container elements 4 contained in the seats 21 of the same group.

As illustrated in FIG. 6, the continuous mass of empty container elements 4 aligned on the conveyor 19, coming from the store 18, is fed in the area of a pick-up station PS, in the area of which an arm 22 is arranged having a plurality of sucking members 23 equal to the number of seats 21 in each group (i.e. fourteen sucking members 23) and arranged above the conveyor 20.

The arm 22 is vertically mobile between a rest raised position and a lowered position. In use, the arm 22 is brought in the lowered position in the area of the conveyor 19, the members enter the container elements 4 and pick them up (by suction); at this point, the arm 22 is raised and moved over the seats 21 and, then, is lowered so as to bring each container element 4 inside a respective seat 21. Subsequently, the members 23 are deactivated, raised and returned back to the conveyor 19.

Note that advantageously, the arm 22 is provided with moving means (of known type per se and not illustrated), which are adapted to distance the member 23 away one from the other by moving them from a closed configuration (as illustrated in FIG. 6) required to pick up the container elements 4 from the conveyor elements 19 to an open configuration needed to permit the insertion of the container elements 4 themselves into the seats 21 (which are spaced apart one from the other).

At this point, the conveyor 20 feeds the container elements 4 from a pick-up station PS through a loading station CS moving below the filling unit 24, which is adapted to insert loose material 14 inside each container element 4.

Figure 7:
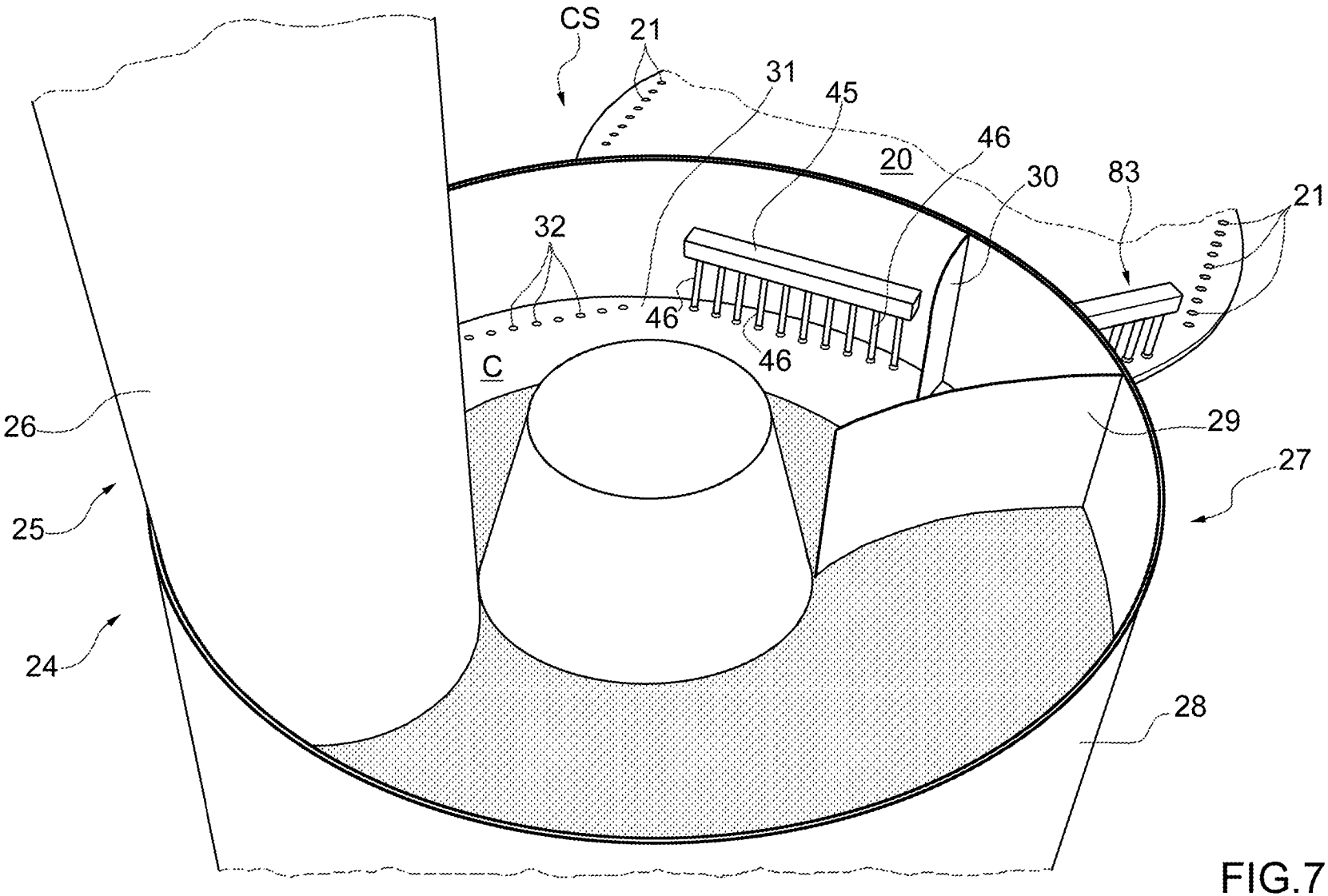
FIG. 7 is a perspective view and from above of a filling unit of the machine of FIG. 1.

Referring to what is illustrated in FIG. 7, the filling unit 14 comprises a fixed upper hopper 25 made by means of a screw conveyor for transporting the tobacco powder. The screw conveyor comprises an outer tubular sleeve 26 having vertical axis, provided, in the area of an upper end of a loading mouth for the tobacco powder which is subsequently discharged in a lower hopper 27.

In the lower hopper 27 an annular chamber C is obtained, for collecting the powder tobacco, delimited by a cylindrical side wall 28. A discharge mouth of the upper hopper 25 is arranged in an area of the collection chamber C diametrically opposite to an area of the collection chamber C in which a pair of scraper elements are housed, respectively indicated with 29 and 30 and, arranged one after the other. In particular, the scraper element 29 is provided to achieve a rough scraping of the powder material; the scraper element 29 is connected to the cylindrical side wall 28 and is made as a bulkhead having a size equal to the width of the collection chamber C. Downstream from the scraper element 29 a further scraper element 30 is provided to achieve a fine scraping of the powder material; the scraper element 30 is fixed to the cylindrical side wall 28 and is made as a bulkhead having a size smaller than the width of the collection chamber C.

The filling unit 24 comprises a plurality of discs arranged under the lower hopper 27 and made for the filling of the empty container elements 4 with loose material 14 which are made to rotate with a given pitch about a common vertical rotation axis.

In particular, a disc 31 defines the bottom wall of the collection chamber C, is connected to the cylindrical side wall 28 and is provided with a number of through-holes 32 formed on the periphery of the disc 31 itself divided into groups; each group has a number of holes 32 arranged in line and equal to the number of seats 21 of each group (i.e. fourteen holes 32 although only ten are illustrated in the Figure).

Figure 8:
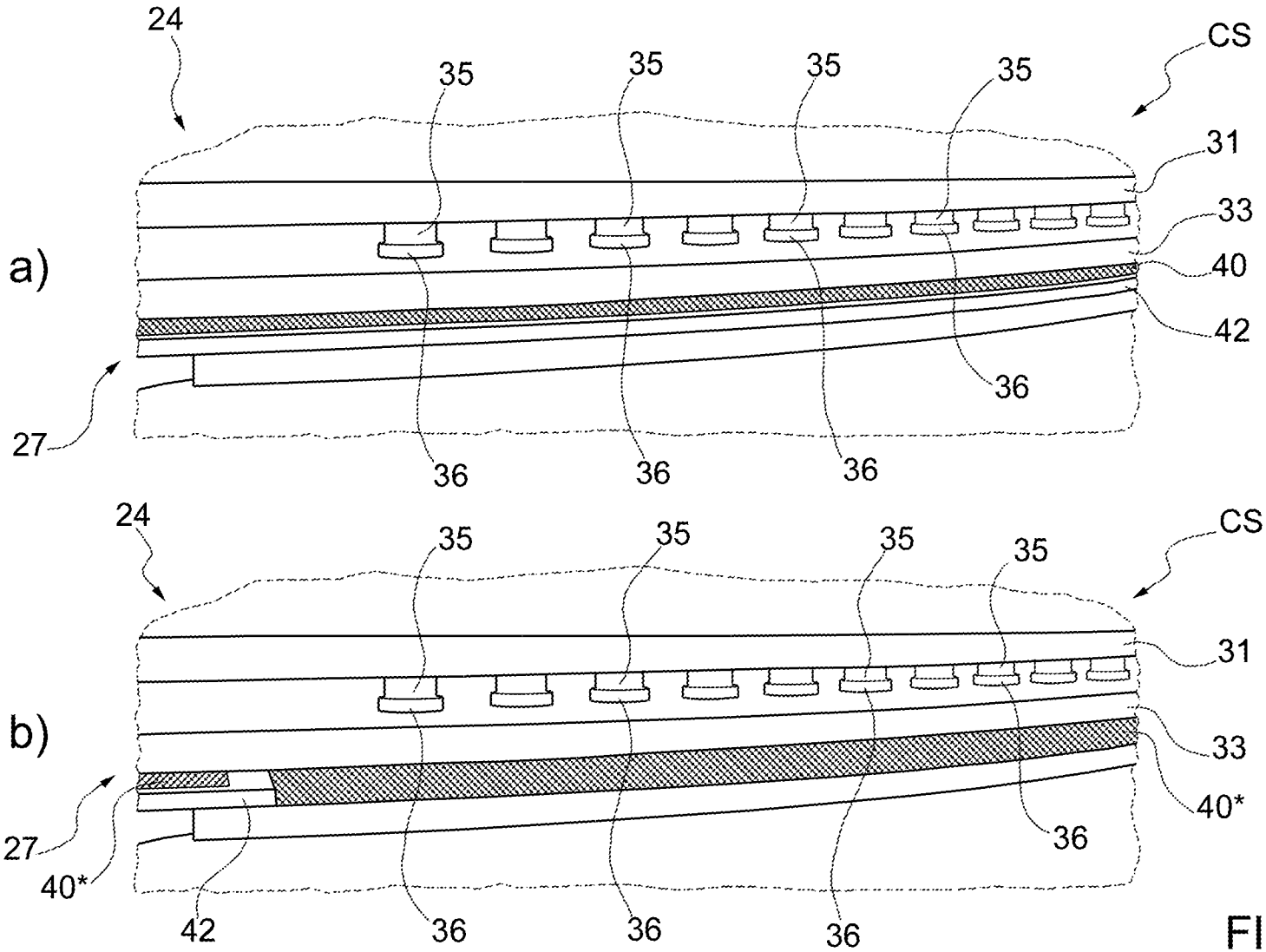
FIGS. 8*a* and 8*b* are perspective views and in side elevation of a detail of the filling unit of the machine of FIG. 1 in two different operating configurations.
Figure 9:
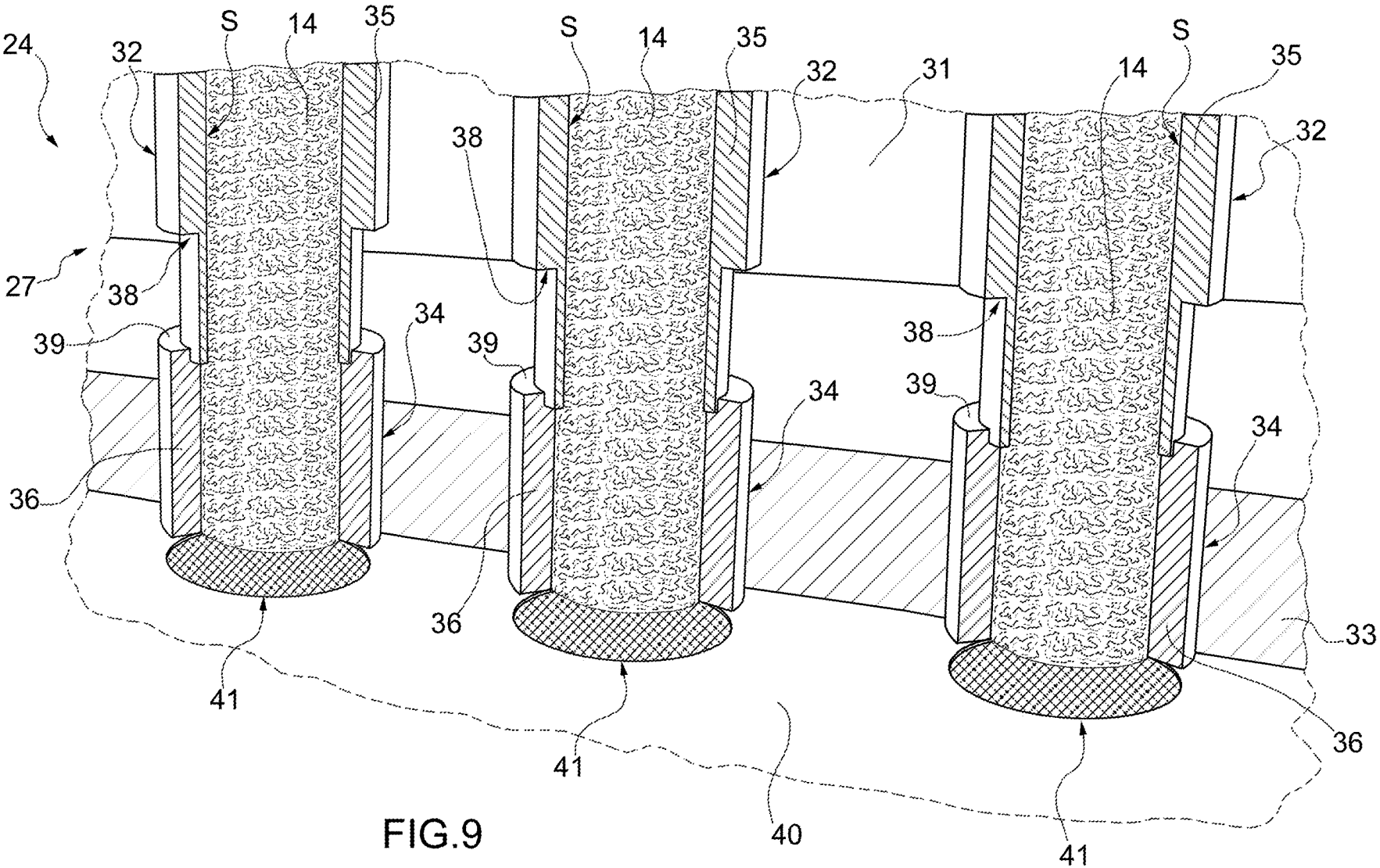
FIG. 9 is a perspective view, partly in section and with parts removed for clarity, of the detail of the filling unit of FIGS. 8*a* and 8*b;*

As illustrated more clearly in FIGS. 8 and 9, under the disc 31 a further disc 33 is provided which is also provided with a number of through-holes 34 formed on the periphery of the disc itself divided into groups; each group has a number of holes 34 arranged in line and equal to the number of seats 21 in each group (i.e. fourteen holes 34, although only ten are illustrated in the figure).

The holes 34 of the disc 33 directly face the holes 32 of the disc 31 so as to define by way of respective pairs of telescopic guides 35, 36 a plurality of compartments S to house a quantity of powdered tobacco. In particular, an upper guide element 35 is inserted inside a hole 32 and cooperates with a respective element 36 of the lower guide housed inside the corresponding hole 34 to define a compartment S for collecting the powdered tobacco.

The two discs 31 and 33 are mobile relative to one another in the vertical direction so as to vary the mutual distance and the volume of the single compartments S between a minimum volume in which a shoulder 38 of the upper guide element 35 abuts on an upper edge 39 of the lower guide element 36 (and the two discs 31 and 33 are arranged at the minimum possible distance from each other) and a maximum volume in which the two discs 31 and 33 are arranged at the maximum possible distance from each other.

According to a preferred embodiment, the disc 31 is mobile in the vertical direction between the two extreme positions which correspond, respectively, to the minimum volume and the maximum volume of the compartments S, and vice versa; while the disc 33 is fixed.

The volume of the single compartments S (that is, the relative distance between the two discs 31 and 33) is determined in a preliminary step of the manufacturing process of the articles 2 as a function of the weight (i.e. the quantity) of powdered tobacco to be inserted into the container elements 4. Alternatively or in addition, the volume of the compartments S is varied as a feedback on the basis of the measurements subsequently made (as described later) so as to have an as precise as possible filling of loose material 14.

The compartments S are filled with the tobacco powder poured from the upper hopper 25 and the action of the two scraper elements 29 and 30, arranged in series inside the collection chamber C, allows to align and level the amount of powdered tobacco contained inside of each compartment S.

Figure 11:
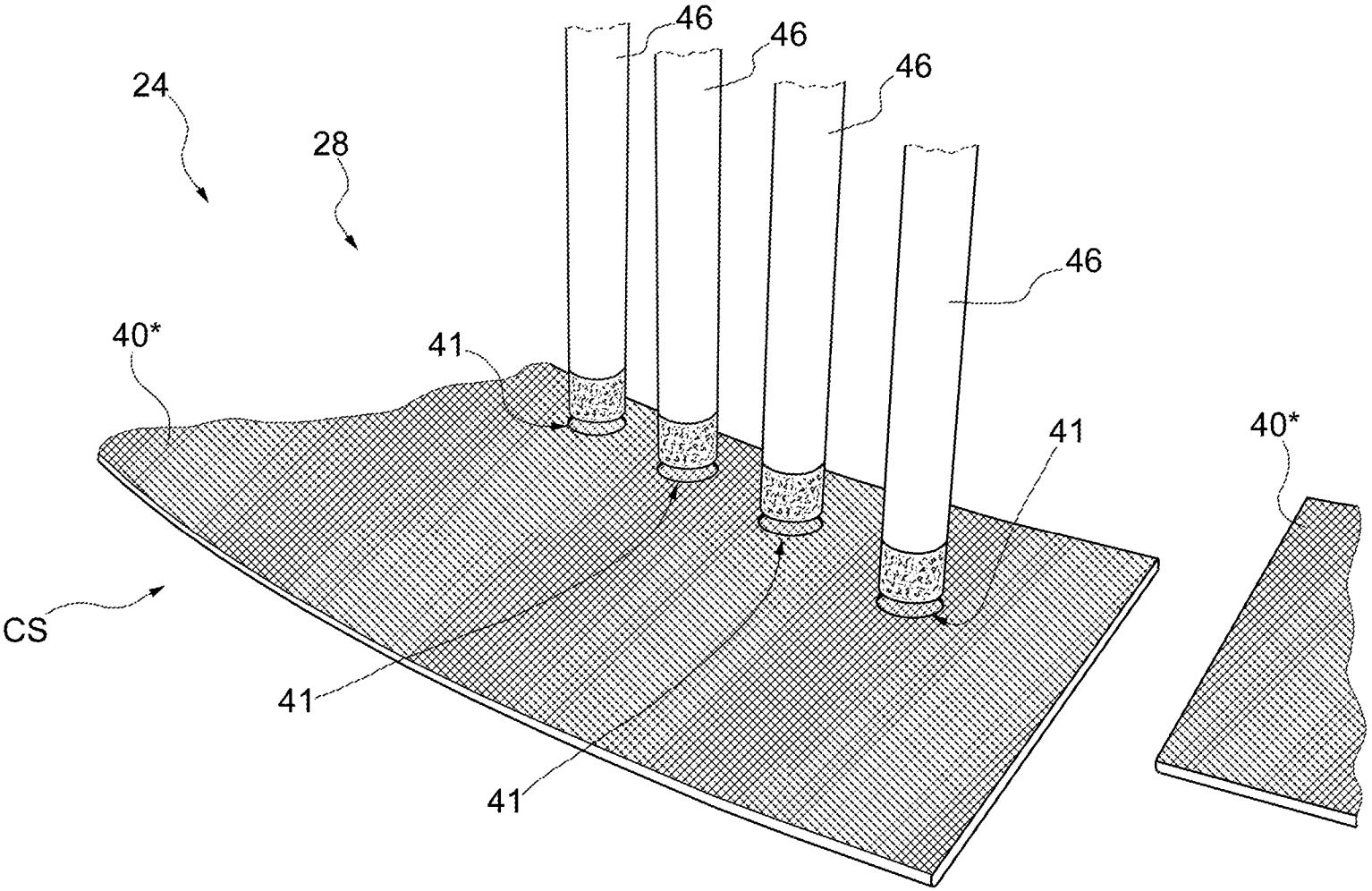
FIG. 11 is a perspective view, with parts removed for clarity, of the filling station of FIG. 10.

As illustrated in FIGS. 8, 9 and 11, each compartment S is closed at the bottom by a further disc 40 arranged under the disc 33, designed as an annular element made of micro-perforated plastic material and divided into a plurality of sectors 40* independent from one another. Each sector 40* is provided with a number of through-holes 41 formed near an inner edge of the sector 40* itself arranged in line and equal to the number of seats 21 in each group (i.e. fourteen holes 41).

Each sector 40* is mobile between two end positions, of which an advanced position (illustrated in FIG. 8*a*) and a retracted position (illustrated in FIG. 8*b*), and vice versa. In the advanced position, the sector 40* defines a base wall of the single compartments S and an outer edge is arranged flush with the outer surfaces of the cylindrical side wall 28 and of the two discs 31 and 33.

From the advanced position the sector 40* is controlled to retract and protrude towards the outside of the filling unit 24 until being arranged in the retracted position, in which each hole 41 is arranged in a position facing a respective hole 34. In other words, each hole 41 is arranged exactly in the area of a respective compartment S.

Figure 10:
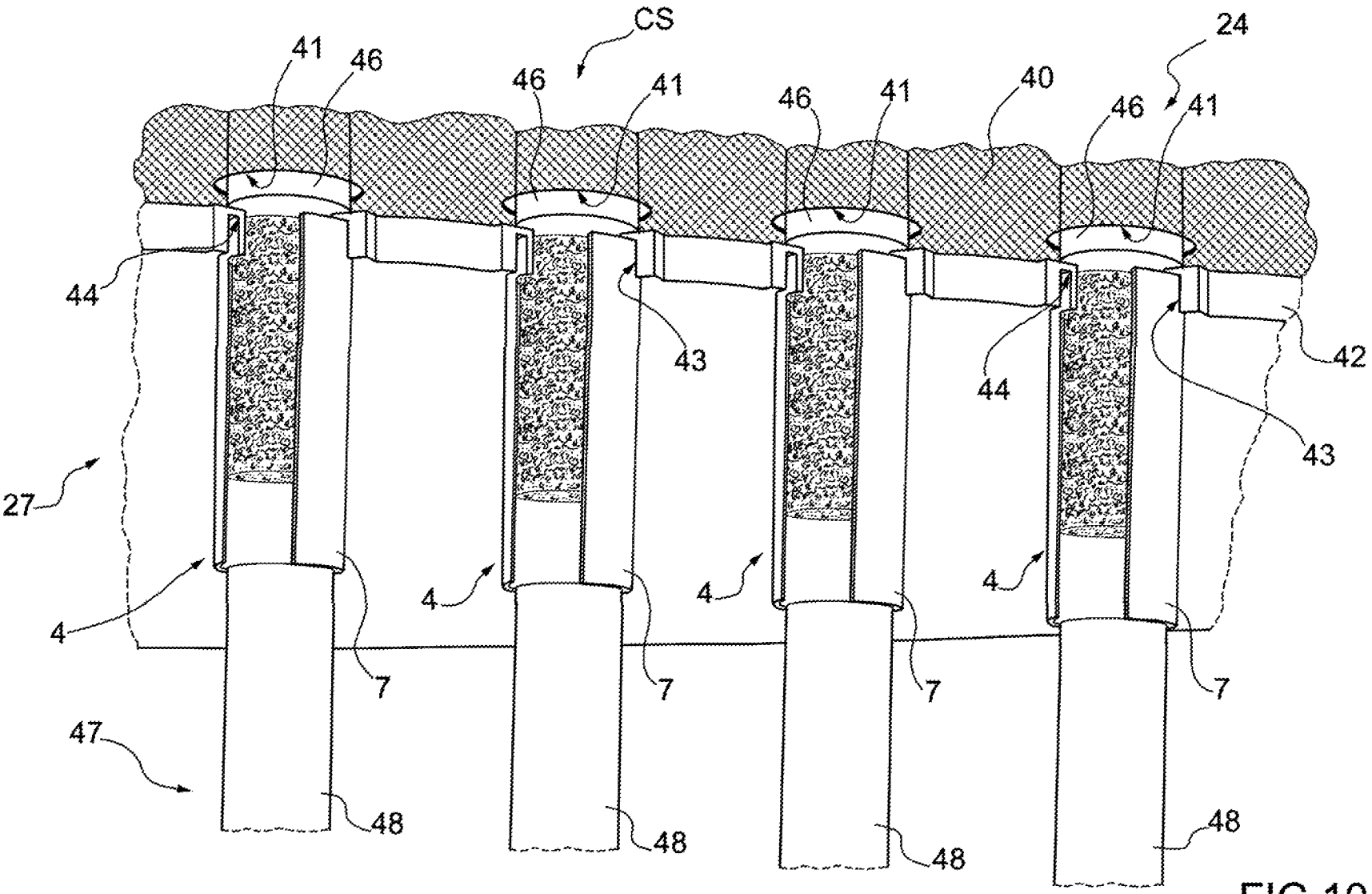
FIG. 10 is a perspective view, partly in section and with parts removed for clarity, of a part of the filling unit of FIG. 7.

Finally, as illustrated in FIG. 10, the filling unit 24 comprises a further disc 42 arranged under the disc 40 and provided with a number of through-openings 43 formed near the outer edge of the disc 42 itself and divided into groups; each group has a number of openings 43 arranged in line and equal to the number of seats 21 in each group (i.e. fourteen openings 43).

In particular, the openings 43 are arranged exactly in the area of a respective compartment S with the interposition of a sector 40*. The openings 43 are delimited by an annular U-shaped edge to define a guiding cavity 44 oriented downwards, on the inside thereof. The guiding cavity 44 serves as a guide for the upper edge of the container element 4 so as to considerably reduce spills and deposits of loose material 14 (in particular, powdered tobacco).

As illustrated in FIG. 7, next to the scraper element 30 inside the collection chamber C, an arm 45 is housed, provided with a plurality of pusher elements 46. In particular, the arm 45 has a number of pusher elements arranged in line and equal to the number of seats of each group 21 (i.e. fourteen pusher elements 46). The arm 45 is mobile in the vertical direction between a raised position and an advanced operating position in which each pusher element 46 is inserted at least partially inside a respective compartment S, and vice versa.

In the area of the loading station CS, an arm 47 is also provided (partly illustrated in FIG. 10) arranged under the disc 42 and provided with a plurality of supporting elements 48. In particular, the arm 47 has a number of supporting elements 48 arranged in line and equal to the number of seats 21 in each group (i.e. fourteen supporting elements 48).

In the loading station CS, the discs 31 and 32, 40 and 42 are stopped in a position that allows each compartment S to be arranged in the area of a respective pusher element 46 and of a respective supporting element 48. The arm 47 is mobile in the vertical direction between a rest position and a raised operating position, and vice versa.

In the area of the loading station CS of the container element 5 with the tobacco powder the following steps take place in succession:

- the conveyor 20 transports the empty container elements 4 in the area of the loading station CS under the disc 42 and above the arm 47;
- the jaws in the seats 21 release the respective container elements 4, each of which is supported by a respective supporting element 48;
- the arm 47 is actuated to move from the rest position to the raised operating position: in this way each supporting element 48 raises the respective container elements 4 until inserting the upper edge in the associated guiding cavity 44;
- the sector 40* moves from the advanced position to the retracted position so that each hole 41 is arranged in the area of the respective hole 34 and of the respective compartment S to allow the tobacco powder contained in the compartment S to descend towards the container element 4;
- the arm 45 is lowered from the raised position to the advanced operating position so that each pusher element 46 is inserted inside the respective compartment S; the movement of the arm 45 towards the advanced operating position is divided into a first step in which the pusher elements 46 accompany the descent of the tobacco powder inside the container elements 4 and a second step in which, once the container elements 4 are filled, the arm 45 accompanies the downward movement of the container elements 4 that disengage the guiding cavity 44;
- once the advanced operating position is reached, the arm 45 moves back again and protrudes out from the compartments S until returning to the raised position;
- simultaneously with the movement of the arm 45, also the arm 47 is actuated to move from the raised operating position to the rest position in which it transfers the container elements 4, containing the tobacco powder, in a respective seat 21 provided with jaws to hold them;
- the sector 40* moves advancing from the retracted position until being arranged again in the advanced position, so as to prevent communication between the compartments S and the openings 43;

the discs 31 and 33, 40 and 42 of the filling unit 24 are finally set in rotation while the conveyor 20 transfers onward the container elements 4 containing tobacco.

It should be pointed out that the movement of the arm 45 which accompanies the descent of the container elements 5 containing the tobacco powder also allows to slightly compress the mass of tobacco powder until the desired density is obtained.

What has been described until now regarding the machine 1 is to be considered as relating to certain particular non-limiting embodiments.

In accordance with a first aspect of the present invention, a machine 1 (in particular, Figures from 1 to 3) is provided, for producing substantially cylindrical articles 2 (see FIGS. 4 and 5) of the tobacco processing industry. Each article 2 is as described above.

The machine 1 comprises a conveyor 20 which is adapted to move at least one container element 4 containing the loose material 14 along a given path P1 through an insertion station IS (see for example FIG. 12) and comprises at least one seat 21 to house the container element 4; an insertion assembly 49, which is adapted to insert the respective substantially rigid element 9 in the container element 4, is arranged in the area of the insertion station IS and comprises a pushing unit 50 to push the substantially rigid element 9 downwards through the end opening 6, so as to partially insert it into the container element 4; and contrast means 51 to exert a resistance on the bottom wall opposite to the push of the pushing unit 50. In this manner it is possible to obtain an insertion of the substantially rigid element in a reproducible, fast and accurate manner and with a low risk of damaging the container element 4.

In particular, the seat 21 is provided with at least one inner lateral surface adapted to be in contact with said side wall 7. Note that in this manner the side wall 7 (which is, according to preferred embodiments, of lightweight and relatively delicate material) is stabilized, thus further significantly reducing the risk of damaging the container element 4.

Advantageously, said contrast means 51 comprise at least one mobile head 52 adapted to move upwards so as to come into contact with the bottom wall 8.

Also this arrangement allows to reduce the risk of damaging the container element 4 (in this case, in particular, the bottom wall 8 is subjected to low stress during the conveying and the insertion into the seat 21).

Advantageously, the conveyor 20 comprises at least two jaws 53, at least one of which is mobile relative to the other, so that the jaws 53 can move from an open configuration (e.g. FIG. 6) to a closed configuration (e.g. FIG. 12) forming the seat 21. In particular, at least one of the two jaws 53 is rotatable (more precisely, can swivel) relative to the other. More precisely, both jaws 53 are mobile (can swivel).

More particularly, the seat 21 is designed to house a container element 4 which collar is arranged (immediately) to the outside of the seat 21 so that the collar is in contact with a surface (upper) of the collar itself.

Note that the jaws 53 as described above (singularly or in combination with the mobile head) allow to be particularly gentle with the container element 4.

According to some embodiments, the machine 1 comprises actuators (of known type and not illustrated; e.g. electric motors or kinematic mechanisms connected to a central motion source) to move the jaws 53.

Advantageously, the seat 21 is open downwards (so as to allow the passage of the mobile head 52). Advantageously, the seat 21 is open upwards (so as to allow the passage of a pusher 50* of the pushing unit 50).

Figure 13:
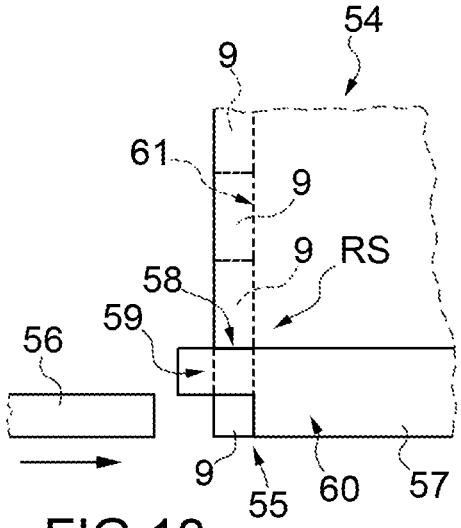
Figure 14:
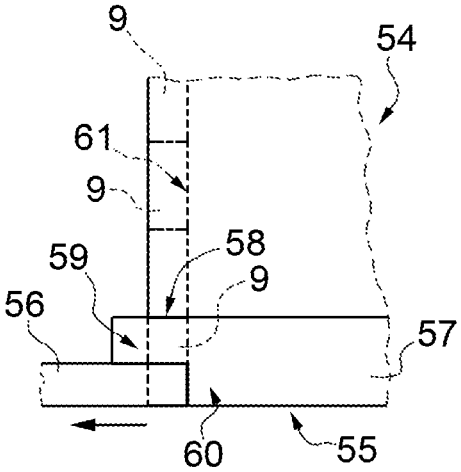
Figure 15:
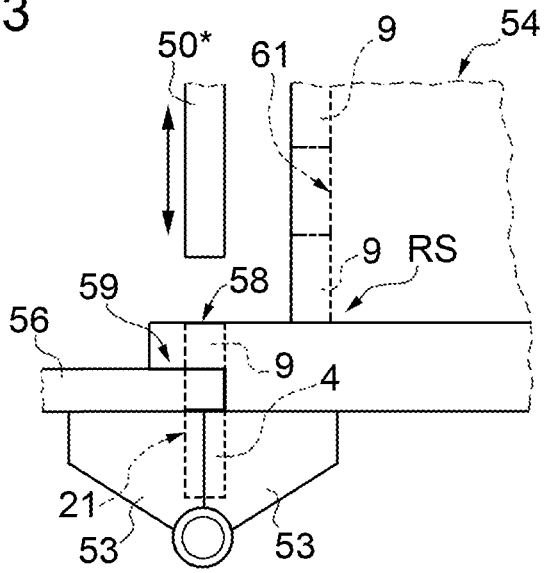

According to some examples of embodiments, the machine 1 also comprises a feeding assembly 54 (e.g. FIGS. 12 and 13), which is adapted to feed the substantially rigid element 9 to the insertion station IS and comprises a transfer device 55 to move the substantially rigid element 9 in a transverse direction relative to the direction in which the pushing unit 50 pushes the substantially rigid element 9 through said end opening 6 (see, in particular, FIGS. 13-15).

Advantageously, the transfer device 55 comprises two half-shells 56 and 57, which are adapted to be coupled to one another so as to house the substantially rigid element 9 between them. In particular, actuating means (of known type and not illustrated; e.g. electric motors or kinematic mechanisms connected to a central motion source) are provided to move the first and second half-shell (separately and together).

More precisely, said actuating means are adapted to move the half-shell 56 through the insertion station IS (independently of the half-shell 57; more in particular, by keeping the half-shell 57 substantially motionless) and the half-shells 56 and together from a collection station RS, in whose area the substantially rigid element 9 is provided to the half-shell 57, to the insertion station IS.

Advantageously, the half-shells 56 and 57, in coupled configuration, have a passage opening 58 (at least partially) facing upwards. The pusher 50* of the pushing unit 50 is adapted to pass through the passage opening 58 to come into contact with the substantially rigid element 9 and to push it towards the container element 4.

In particular, the passage opening 58 is formed (only) in the half-shell 57. More specifically, the half-shell 57 comprises an upper portion 59, which is adapted to surround a first (upper) part of the substantially rigid element 9 and is provided with the opening 58 facing upwards adapted to allow the passage of the substantially rigid element 9; and a lower portion 60 adapted to cooperate with the half-shell 56 to surround a second (lower) part of the substantially rigid element 9.

According to some embodiments, the feeding assembly 54 comprises at least one feeding channel 61 for conveying the substantially rigid element 9 to the transfer device 55, in particular to the collection station RS.

In particular, the channel 61 is adapted to feed the rigid element 9 longitudinally and downwardly (in particular, substantially vertically).

More precisely, the feeding channel 61 is oriented downwards (it extends from top to bottom) so that the substantially rigid element 9 moves inside the feeding channel 61 itself taking advantage of the force of gravity.

According to specific embodiments, the feeding channel 61 is adapted to house a column of substantially rigid elements 9 arranged one on top of the other.

In particular, the feeding channel 61 is adapted to bring the substantially rigid element through the passage opening 58.

According to some embodiments, the feeding assembly 54 comprises a plurality of feeding channels 61, arranged one after the other, and a distribution device 62. In particular, the distribution device 62 is adapted to bring the substantially rigid elements 9 to the different channels 61.

Advantageously, the distribution device 62 comprises a deformable duct 63 adapted to feed the substantially rigid elements 9 to (upper) ends 64 of the feeding channels 61 opposite to the transfer device 55.

In particular, the machine 1 (more specifically, the feeding assembly 54) comprises further actuating means (of known type and not illustrated; e.g. electric motors or kinematic mechanisms connected to a central motion source) to move one discharge end 65 of the deformable duct 63 in a direction parallel to the succession of feeding channels 61. In this way the discharge end 65 can be brought in the area of the channel 61 that actually requires the substantially rigid elements 9, which channel 61 is thus replenished.

Advantageously, the additional actuating means are adapted to move the discharge end 65 also in a transverse direction to the direction parallel to the succession of feeding channels 61. In this way, it is possible to avoid feeding the channels that do not require it (by moving, practically, in front and/or in back of the ends 64).

Advantageously, offset (and parallel) with respect to the succession of feeding channels 61 a support surface is provided, on which the discharge end 65 can slide to avoid that the substantially rigid elements 9 come out from the same.

According to some embodiments, the machine 1 (more specifically, the feeding assembly 54) comprises sensors (of a known type and not illustrated) to detect the presence of substantially rigid elements 9 inside the feeding channels 61; and a control unit (of known type and not illustrated) designed to activate the further actuating means as a function of what has been detected by the sensors. For example, the sensors may be able to signal when the column of substantially rigid elements 9 contained in a channel 61 is below a minimum level or above a maximum level.

The feeding of the substantially rigid elements 9 as described above is particularly efficient and precise.

According to some embodiments, the feeding assembly 54 comprises at least one store 54* (of type known per se) and a conveyor 62* to bring the substantially rigid elements to the distribution device 62. Advantageously, in the stores 54* a selection and collection system is provided able to select and pick up the rigid elements 9 oriented according to the needs.

In accordance with a second aspect of the present invention, a machine 1 is provided (in particular, Figures from 1 to 3) for producing substantially cylindrical articles 2 (see FIGS. 4 and 5) of the tobacco processing industry. Each article 2 is as described above.

The machine 1 comprises a conveyor 66 which is adapted to move at least one combined element 67, comprising (in particular, made up of) the substantially rigid element 9 and the container element 4, along a given path P2 through an insertion station IS2 and it comprises at least one seat 68, which is designed to house the combined element 67 and comprises a blocking device 69 adapted to block the substantially rigid element 9 and to leave the container element 4 at least partially free in the area of the insertion station IS2; an insertion assembly 70, which is adapted to at least partially insert the combined element 67 into the corresponding tubular body 3, it is arranged in the area of the insertion station IS2 and comprises a pushing unit 71 to push one of the combined element 67 and the tubular body 3 towards the other (in particular, so that at least part of the container element 4 is inserted into the tubular body 3).

More precisely, the pushing unit 71 is adapted to push the tubular body 3 towards the combined element 67.

According to some embodiments (such as that illustrated in the figures), the conveyor is adapted to feed with intermittent motion (i.e. with a non-continuous motion which provides a cyclic alternation of motion steps) a group of combined elements 67 to the insertion station IS2 so that during a stationary step, the pushing unit 71 inserts a plurality of combined elements 67 in respective tubular bodies 3.

In some cases, the pushing unit 71 comprises a plurality of pushers adapted to push, each one, a respective tubular body 3 simultaneously.

In particular, the conveyor 66 is adapted to move the combined element 67 in a transverse direction (with respect to the longitudinal extension of the combined element 67). More precisely, the conveyor 66 is adapted to move the combined element 67 horizontally.

In particular, the conveyor 66 is adapted to move the groove 72 in a transverse direction.

According to the example illustrated in the Figures, the seat 68 is configured so that said end opening 6 (engaged by the substantially rigid element 9) of the container element 4 arranged in the seat 68 itself is laterally oriented (in particular, substantially horizontally).

In some cases (as for the example illustrated), the conveyor comprises at least one groove 72 designed to house the tubular body 3. The seat 68 is arranged facing an open end of said groove 72 (in the direction of the longitudinal extension of the groove). In particular, the seat 68 comprises an opening 73, adapted to be traversed by the combined element 67 (when the combined element 67 is arranged in the seat 68) and pointing towards and facing the groove 72. In other words, the combined element 67 (when carried by the conveyor 66) extends through an opening 73 of the seat 72, which opening faces towards the groove 72.

Advantageously, the insertion assembly 70 comprises a plate 73 (FIGS. 18-20) provided with a second groove 74, which is designed to house the tubular body 3; and actuating means (of known type and not illustrated; e.g. electric motors or kinematic mechanisms connected to a central motion source) to move the plate 73 between a rest position (FIG. 18), in which the plate 73 itself is separate from the conveyor 66, and an operating position (FIGS. 19 and 20), in which the plate 73 is coupled to the conveyor 66 so that the groove 74 faces (is placed on top of) the groove 72, thus defining a tubular channel together, shaped so as to allow the (longitudinal) sliding of the tubular body 3 in the inside thereof.

The plate 73 helps to keep the tubular body 3 properly oriented and therefore, to make the insertion of the combined element 67 in the tubular body 3 itself more precise.

Advantageously, the blocking device 69 comprises a blocking element 75 adapted to block at least one part of the substantially rigid element 9; a blocking element 76 for surrounding at least partially said container element 4; and actuating means (of known type and not illustrated; e.g. electrical motors or kinematic mechanisms connected to a central motion source) to move the blocking element 76 independently of the blocking element 75 (more precisely, relative to the blocking element 75) so that at least one part of the container element 4 is free from snags and can be inserted into the tubular body 3.

Advantageously, the seat 68 is configured so that the collar is arranged in contact with an outer surface of the blocking element 75.

According to some embodiments, the machine 1 comprises a feeding assembly 77, which is adapted to feed the tubular body 3 to the conveyor 66, in particular in the respective groove 72, and, in particular, is provided with a pushing assembly 78 to push the tubular body 3 longitudinally (and horizontally) in the respective groove 72.

In some cases, the feeding assembly 77 comprises a store 79, in which a mass of tubular bodies 3 is kept with substantially horizontal orientation. In particular, the pushing assembly 78 is adapted to move the tubular body 3 from the store 79 (more precisely, from the lower outlet of the store 79).

Advantageously, the conveyor 66 is adapted to move with an intermittent motion so as to bring a group of combined elements 67, substantially simultaneously, in the area of the insertion station IS2. The insertion assembly 70 being adapted to insert a plurality of combined elements 67 at least partially, each, into a respective tubular body 3.

In some cases, such as that illustrated, the machine 1 also comprises a discharge arm 66* which is adapted to pick up groups of articles 2 from the conveyor 66 and to feed them to a further output conveyor.

Advantageously, what has been indicated for the machine 1, of the first aspect of the present invention, is in combination with what is indicated relatively to the machine 1, of the second aspect of the present invention.

In accordance with a third aspect of the present invention, a method for producing substantially cylindrical articles 2 (see FIGS. 4 and 5) of the tobacco processing industry is provided. Each article 2 is as described above.

The method comprises a conveying step for conveying the container element 4 with the end opening 6 facing upwards along a given path P1 through a loading station CS and a first insertion station IS arranged downstream from the loading station CS; a loading step, during which the loose material 14 is inserted into the container element 4 in the area of the loading station CS; a first insertion step, which takes place after the loading step, and during which the substantially rigid element 9 is (at least) partially inserted into the container element 4 by being moved downwards, so as to obtain a combined element 67; and a second insertion step, which takes place after the first insertion step and during which the combined element 67 is at least partially inserted into the tubular body 3 (so as to obtain a substantially cylindrical article 2 of the tobacco processing industry).

According to some embodiments, the method comprises a rotation step, which takes place after the first insertion step and during which the combined element 67 is caused to rotate so that the end opening 6 (engaged by the substantially rigid element) is facing essentially laterally (in particular, horizontally); during the second insertion step, at least one of the combined element 67 and the tubular body 3 is moved in a substantially horizontal direction, so as to insert, at least partially, the combined element 67 into the tubular body 3.

Advantageously, the method comprises a transfer step, which takes place after the first insertion step and before the rotation step and during which the combined element 67 is secured, on its upper and lower end, by two blocking elements 80 and 81 which move (with a tong-like movement) in opposite directions (one towards the other) and that come into contact with the substantially rigid element 9 and, with the container element 4 (by picking up the combined element 67), respectively, keeping the end opening 6 (engaged by the substantially rigid element 9) facing upwards, and laterally picked up by a pick-up unit 82*, which is caused to rotate on itself (around a substantially horizontal axis).

In particular, the transfer step takes place in the area of a transfer station TS arranged between the paths P1 and P2, and so that the combined element 67 is brought from the path P1 to the path P2. More precisely, the transfer is achieved by a transfer device 82 (which comprises the pick-up unit 82*).

According to some embodiments, during the transfer step, the pick-up unit 82* (after rotating on itself, in particular around a substantially horizontal axis), places the combined element 67 on a substantially horizontal conveyor 66.

According to some embodiments, the method comprises a transport step during which the combined element 67 is moved along a given path P2 through an insertion station IS2, in whose area the second insertion step takes place. In particular, during the transport step the combined element 67 has the end opening 6 (engaged by the substantially rigid element 9) laterally oriented (in particular, horizontally).

Advantageously, during the conveying step (and, in particular, the transfer and transport steps) a group of container elements 4 (and combined elements 67, respectively) is conveyed together with an intermittent motion (i.e. a non-continuous motion which provides a cyclic alternation of motion steps and stationary steps) so that during a stationary step (a plurality of) substantially rigid elements 9 are substantially simultaneously inserted, each, into a respective container element 4 of said group.

In addition or alternatively, during the transfer and transport steps, a group of combined elements 67 is conveyed together with an intermittent motion (i.e. a non-continuous motion which provides a cyclic alternation of motion steps and stationary steps) so that during a stationary step the combined elements 67 of the group are inserted (substantially simultaneously), each, into a respective tubular body 3.

Advantageously, the method comprises a first control step, which takes place after the loading step and before the first insertion step and during which the amount of loose material in the container element 4 is estimated (detected); in particular, during the conveying step the container element 4 is conveyed through a control station VS, which is arranged (along the path P1) between the loading station CS and the insertion station IS and in the area of which the first control takes place. In particular, during the first control step the level of loose material 14 in the container element 4 is detected (by means of a laser probe 83—FIG. 7).

Advantageously, the method comprises a removal step, which takes place after the first insertion step (and, in particular, at the first control step) and before the second insertion step during which the combined element 67 is removed from the given path P1. In particular, the removal step occurs at a removal station WS, arranged along the path P1 downstream from the insertion station IS (more precisely, upstream from the transfer station TS).

In this way, it is possible to eliminate the combined elements which prove flawed following the first control step. Alternatively or additionally it is possible to weigh the removed combined element 67 (or the removed combined elements 67) in order to make a further (more accurate) sample control. In these cases, the removed combined element 67 (or the removed combined elements 67) can be weighed.

Advantageously, the method comprises a second control step, during which the force exerted to insert the substantially rigid element 9 into the container element 4 is detected. In this way, it is verified that the combined element 67 has the right features.

In this regard, note that if the detected force is excessive it is likely that this is due to the fact that the substantially rigid element 9 has come incorrectly into contact with the side wall 7 (presumably deforming the same). If the measured strength is low it is likely that this is due to the fact that the section of the container element 4 is too loose relative to the substantially rigid element 9.

In addition or alternatively, the method comprises a third control step, during which the force exerted to insert the combined element 67 into the tubular body 3 is detected (so as to verify that the substantially cylindrical article 2 has the right features).

According to some embodiments, the method comprises an application step, during which glue is applied inside the side wall 7. The application step takes place before the first insertion step and, preferably, after the loading step. The application step being advantageously carried out in the area of an application station arranged along the path P1 between the loading station CS and the insertion station IS. In particular, the glue being applied (in drops) by a sprayer.

In particular, the method is implemented by a machine 1 according to the first and/or to the second aspect of the present invention.

The invention claimed is:

1. A machine for producing substantially cylindrical articles (2) of the tobacco processing industry; each article (2) comprises a tubular body (3); a container element (4), which is arranged in the area of a first end (5) of the tubular body (3) and has an end opening (6) facing outwards, at least one side wall (7) and a bottom wall (8) opposite to said end opening (6); a substantially rigid element (9), partially housed inside the container element (4) and having an end portion (10), which protrudes through said end opening (6) to the outside of the container element (4); and loose material (14), which is arranged inside the container element (4) between the substantially rigid element (9) and the bottom wall (8);

the machine (1) comprising a conveyor (20) which is adapted to move at least one container element (4) containing the loose material (14) along a given path (P1) through an insertion station (IS) and comprises at least one seat (21) designed to house the container element (4) and provided with at least one inner lateral surface adapted to be in contact with said side wall (7); an insertion assembly (49), which is designed to insert the respective substantially rigid element (9) into the container element (4), is arranged in the area of the insertion station (IS) and comprises a pushing unit (50) to push the substantially rigid element (9) downwards through said end opening (6), so as to partially insert it into the container element (4); and contrast means (51) to exert a resistance on the bottom wall (8) which is opposite to the push exerted by the pushing unit (50), and a feeding assembly (54), which is adapted to feed the substantially rigid element (9) to the insertion station (IS) and comprises a transfer device (55) to move the substantially rigid element (9) in a transverse direction relative to the direction in which the pushing unit (50) pushes the substantially rigid element (9) through said end opening (6), wherein the transfer device (55) comprises a first and a second half-shell (56, 57), which are adapted to be coupled to one another so as to house the substantially rigid element (9) between them, and actuating means to move the first and the second half-shell (56, 57).

2. A machine according to claim 1, wherein said contrast means (51) comprise at least one movable head (52) adapted to move upwards so as to come into contact with the bottom wall (8).

3. A machine according to claim 1, wherein the conveyor (20) comprises at least two jaws (58), at least one of which is mobile relative to the other, so that the jaws (58) can move from an open configuration to a closed configuration defining said seat (21).

4. A machine according to claim 1, wherein the conveyor (20) comprises two jaws (58), at least one of which can rotate relative to the other, so that the jaws (58) can move from an open configuration to a closed configuration defining said seat (21).

5. A machine according to claim 1, wherein the first and the second half-shell (56, 57), when in the coupled configuration, have a passage opening (58) at least partially facing upwards; the pushing unit (50) comprises at least one pusher (50*) adapted to pass through the passage opening (58) so as to come into contact with the substantially rigid element (9) and push it towards the container element (4).

6. A machine according to claim 1, wherein said actuating means are adapted to move the first half-shell (56) through the insertion station (IS) and the first and second half-shell (56, 57) together from a collection station (RS), in whose area the substantially rigid element (9) is fed to the second half-shell (57), to the insertion station (IS).

7. A machine according to claim 1, wherein the second half-shell (57) comprises an upper portion (59), which is adapted to surround a first part of the substantially rigid element (9) and is provided with a passage opening (58) facing upwards and adapted to permit the passage of the substantially rigid element (9); and a lower portion (60) adapted to cooperate with the first half-shell (56) so as to surround a second part of the substantially rigid element (9).

8. A machine according to claim 1, wherein the feeding assembly (54) comprises at least one feeding channel (61) adapted to convey the substantially rigid element (9) to the transfer device (55).

9. A machine according to claim 8, wherein the feeding channel (61) is oriented downwards, so that the substantially rigid element (9) moves inside the feeding channel (61) itself by taking advantage of the force of gravity; in particular, the feeding channel (61) is adapted to house a column of substantially rigid elements (9) arranged one on top of the other.

10. A machine according to claim 8, wherein the second half-shell (57) comprises an upper portion (59), which is adapted to surround a first part of the substantially rigid element (9) and is provided with a passage opening (58) facing upwards and adapted to permit the passage of the substantially rigid element (9); the feeding channel (61) being adapted to bring the substantially rigid element (9) through the passage opening (8).

11. A machine according to claim 8, wherein the feeding assembly (54) comprises a plurality of feeding channels (61), arranged one after the other, and a distribution device (62), which comprises a deformable duct (63) adapted to feed the substantially rigid elements (9) to the ends (64) of the feeding channels (61) which are opposite to the transfer device (55).

12. A machine according to claim 11, and comprising further actuating means designed to move a discharge end (65) of the deformable duct (63) in a direction that is parallel to the succession of feeding channels (61).

13. A machine according to claim 12, and comprising sensors adapted to detect the presence of substantially rigid elements (9) inside the feeding channels (61); and a control unit designed to activate the further actuating means as a function of what has been detected by the sensors.

* * * * *